US005688621A

United States Patent [19]

Takegawa et al.

[11] Patent Number: 5,688,621

[45] Date of Patent: Nov. 18, 1997

[54] ELECTROPHOTOGRAPHIC PHOTORECEPTOR AND IMAGE FORMING METHOD

[75] Inventors: Ichiro Takegawa; Takaaki Kimura, both of Minami Ashigara, Japan

[73] Assignee: Fuji Xerox Co., Ltd., Tokyo, Japan

[21] Appl. No.: 571,556

[22] Filed: Dec. 13, 1995

[30] Foreign Application Priority Data

Dec. 14, 1994 [JP] Japan ..... HEI.6-332406

[51] Int. Cl.[6] ..... G03G 5/10

[52] U.S. Cl. ..... 430/64; 430/126

[58] Field of Search ..... 430/56, 62, 63, 430/64, 65, 126

[56] References Cited

U.S. PATENT DOCUMENTS

| | | | |
|---|---|---|---|
| 3,312,547 | 4/1967 | Levy | 430/131 |
| 3,619,153 | 11/1971 | Lipani | 117/218 |
| 5,215,839 | 6/1993 | Yu | 430/63 |
| 5,252,422 | 10/1993 | Okano et al. | 430/131 |

FOREIGN PATENT DOCUMENTS

| | | |
|---|---|---|
| 1926056 | 5/1969 | Germany . |
| 3228218 | 3/1983 | Germany . |
| A-49-39425 | 4/1974 | Japan . |
| A-50-99326 | 8/1975 | Japan . |
| A-52-10138 | 1/1977 | Japan . |
| A-52-20836 | 2/1977 | Japan . |
| A-52-25638 | 2/1977 | Japan . |
| A-52-100240 | 8/1977 | Japan . |
| A-52-121325 | 10/1977 | Japan . |
| A-54-26739 | 2/1979 | Japan . |
| A-58-93062 | 6/1983 | Japan . |
| A-60-111255 | 6/1985 | Japan . |
| A-61-110153 | 5/1986 | Japan . |
| A-2-59767 | 2/1990 | Japan . |
| A-4-124673 | 4/1992 | Japan . |
| 2179166 | 2/1987 | United Kingdom . |

*Primary Examiner*—John Goodrow
*Attorney, Agent, or Firm*—Oliff & Berridge

[57] ABSTRACT

An electrophotographic photoreceptor excellent in electric characteristics and having few defects in image quality, and an image forming method for forming an image free from defects in image quality by the contact charging system. The inventive electrophotographic photoreceptor comprising a conductive substrate having thereon an undercoat layer and a photosensitive layer, in which the undercoat layer comprises a copolymer resin having a hydrolytic silyl group. The copolymer resin having hydrolytic silyl groups is preferably an acrylic copolymer resin. Further, the undercoat layer may contain electrically conductive particles. When an image is formed using this electrophotographic photoreceptor, a method comprising contacting a charging device with a surface of the electrophoto-graphic photoreceptor and supplying charge from the outside to charge the photoreceptor can be employed.

16 Claims, 1 Drawing Sheet

FIGURE
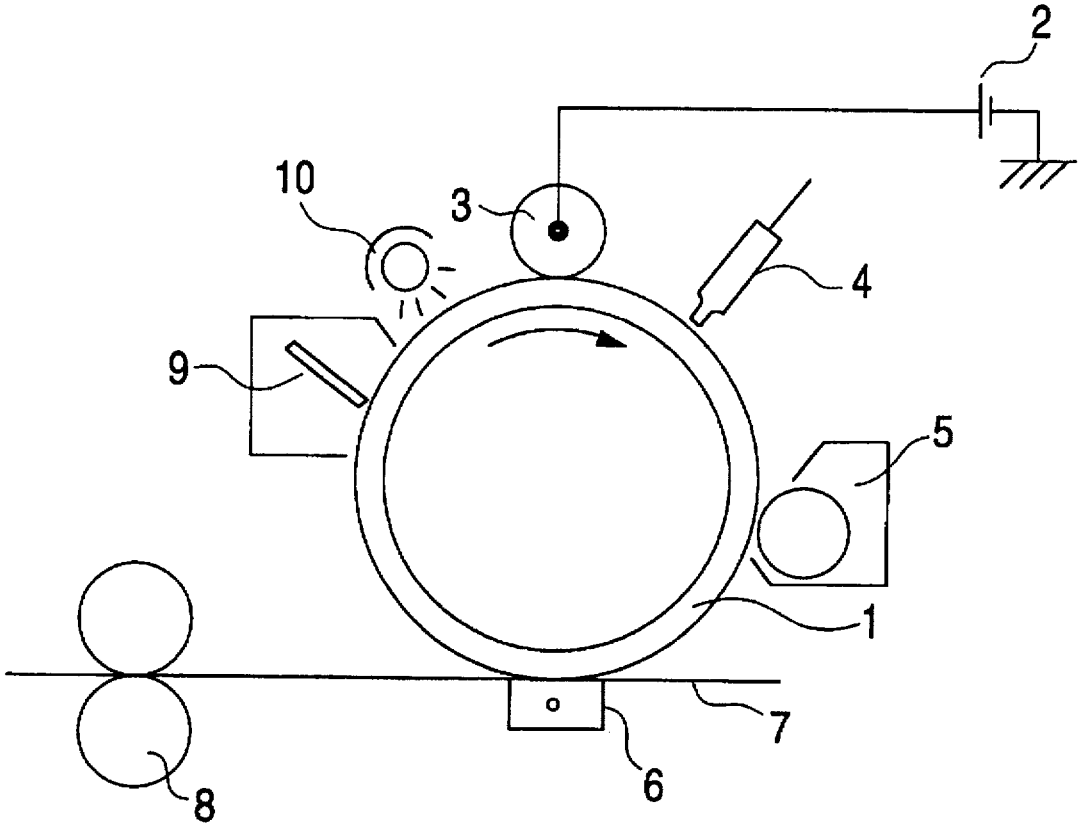

ELECTROPHOTOGRAPHIC PHOTORECEPTOR AND IMAGE FORMING METHOD

FIELD OF THE INVENTION

The present invention relates to an electrophotographic photoreceptor having an improved undercoat layer, and an image forming method using the same.

BACKGROUND OF THE INVENTION

Electrophotographic machines provide high print quality in high speed, and are utilized in the fields of copying machines, laser printers, etc. As photoreceptors used for the electrophotographic machines, the development of organic photoreceptors (OPCs) using organic photoconductive materials have been proceeded, and they have been popularized. The constitution of photoreceptors has also been changed from the charge transporting type complex structure or the monolayer structure in which charge generating materials are dispersed in binder resins to the function-separated structure in which a charge generating layer is separated from a charge transporting layer, to thereby enhance performance. In this constitution of the function separation type photoreceptors, the constitution of forming an undercoat layer on an aluminum substrate, and forming a charge generating layer and a charge transporting layer thereon have become the main current at present.

With the development of electrophotographic machines, images having higher quality have been desired in the performance of the photoreceptors. With respect to improvements of repetition stability and environmental stability of the photoreceptor, any of the charge generating layer, the charge transporting layer and the undercoat layer has an important effect on each of electrophotographic characteristics such as sensitivity, image quality and repetition stability. Further, various kinds of pipes such as extruded pipes, ED pipes and EI pipes have been used for substrates to reduce cost and to improve image defects. Furthermore, to reduce interference fringes, methods of roughening surfaces of a substrate have been studied.

However, the surfaces of the substrates have many defects such as crystallized products, pickups and hollows. For example, the ED pipes used as low-cost pipes have pickups, that is, gouges on the aluminum substrates, and ones having a size reaching 20 μm have been found. Such surface defects generate uneven portions in the state of a photoreceptor film formed thereon to bring about local concentrations of electric field when the photoreceptor is charged. This causes charge leaks. Further, when the substrates are used in the contact charging process using a charging roll, charge leaks take place between the substrate and the charging roll due to the above-described surface defects of the conductive substrate or defects of a coated film, resulting in black spot or white spot defects. When this phenomenon is significant, the charging ability of the charging rolls themselves is decreased, and the photoreceptors are poorly charged over the axial direction thereof.

Further, in some photoreceptors, the aluminum substrates are sometimes subjected to honing, rough lathing, etching treatment, etc. to roughen the surfaces thereof. In some cases, however, abnormal protrusions are locally produced on the surfaces of the substrates by roughening. Also in this case, the generation of defects In image quality and the occurrence of charge leaks on contact of the photoreceptor with a charging roll introduce problems. It is effective to solve these problems to form an undercoat layer having sufficient substrate covering ability and carrier blocking property on the surface of the substrate, or to form a conductive layer to cover the defects of the substrate.

As the undercoat layer formed on the surface of the substrate, various resins are known. For example, maleic acid ester copolymers are disclosed in JP-A-52-10138 (the term "JP-A" used herein means an "unexamined published Japanese patent application"), polyester resins in JP-A-52-20836, nylon copolymers in JP-A-52-25638, polyvinyl alcohol in JP-A-52-100240, epoxy resins in JP-A-52-121325, end styrene-butylene resins in JP-A-5-54-26739. In addition, as methods for forming the conductive layer, dispersions of a metal oxide such as titanium oxide, tin oxide, etc. in polyamides (JP-A-61-110153), phenol resins (JP-A-60-111255), epoxy resins (JP-A-61-110153), urethane resins (JP-A-61-110153), etc. have been proposed.

However, when the above described undercoat layer or conductive layer is formed, secondary obstacles such as an increase in residual potential in electronic characteristics and an increase in environmental fluctuation, and the effect of improving defects in image quality such as black spots or white spots is not at a sufficient level in many cases.

On the other hand, use of compounds containing hydrolytic silyl groups in the undercoat layer is also proposed. Typical examples of the compound containing a hydrolytic silyl group include silane coupling agents. The photoreceptors comprising a substrate having thereon a silane coupling agent are excellent in adhesion of the substrate with photosensitive layer, good in electric characteristics, namely low in residual potential, excellent in repetition stability and environmental stability, and excellent in ability to prevent defects in image quality such as black spots, fog or white spots. Therefore, these photoreceptors are utilized for practical applications (for example, JP-A-49-39425 and JP-A-50-99326). However, for the undercoat layer using the silane coupling agent, it is difficult to form a thick film, and the thickness of the film which can be usually formed is on the order of submicron. Then, it is proposed that the resins and the silane coupling agents are mixed to improve film formability (JP-A-58-93062, JP-A-2-59767 and JP-A-4-124673). According to such methods, however, cracks develop in the film when the amount of resin components is small, actually resulting in failure to obtain a thick film. When the amount of resin components is increased, the resistance is largely increased to cause an increase in residual potential. The range capable of obtaining thick films is therefore actually up to about 1 to about 2 μm, and such methods have not been sufficient to prevent various defects in image quality related to protrudent substrate defects such as pickups.

To solve the above-described problems in the conventional art, the present inventors have made the invention for the purpose of forming materials for the undercoat layer which provides images having higher quality without adverse effect on electric characteristics.

SUMMARY OF THE INVENTION

It is therefore an object of the present invention to provide an electrophotographic photoreceptor which are excellent in electric characteristics and has few defects in image quality.

Another object of the present invention is to provide an electrophotographic photoreceptor capable of forming an image free from defects in image quality in a contact charge type image forming method.

Still another object of the present invention is to provide an image forming method using the above described electrophotographic photoreceptor.

The present inventors have studied materials for the undercoat layer which provides high image quality without adverse effect on electric characteristics. As a result, the present inventors have discovered that copolymer resins having a hydrolytic silyl group satisfy the above-described objects, thus achieving the invention.

Therefore, the present invention relates to an electrophotographic photoreceptor comprising a conductive substrate having thereon an undercoat layer and a photosensitive layer, wherein the undercoat layer comprises a copolymer resin having a hydrolytic silyl group.

In the present invention, the copolymer having a hydrolytic silyl group is preferably an acrylic copolymer resin. Further, the undercoat layer may contain electrically conductive particles.

The present invention also relates to an image forming method comprising the steps of:

supplying a charge from a power source to a charging device;

charging an electrophotographic photoreceptor comprising a conductive substrate having thereon an undercoat layer and a photosensitive layer in this order, by the charging device;

imagewise exposing the photoreceptor to form a latent image thereon;

developing the latent image to form a toner image;

transferring the toner image; and fixing the transferred image, wherein the undercoat layer comprises a copolymer resin having a hydrolytic silyl group, and the charging step is conducted by contacting the charging device with the surface of the electrophotographic photoreceptor to supply charge from the power source.

BRIEF DESCRIPTION OF THE DRAWING

A FIGURE is a schematic view illustrating one embodiment of the constitution of a printer for use in the image forming method according to the present invention.

DETAILED DESCRIPTION OF THE INVENTION

The present invention is described in detail below.

The electrophotographic photoreceptor of the present invention has the constitution that the undercoat layer is formed on the conductive substrate and the photosensitive layer is further formed thereon. The photoreceptor is effective even if it has any layer constitution, but a multilayer type photoreceptor where the photosensitive layer comprises a charge generating layer and a charge transporting layer as a surface layer is preferred because it is excellent in performance such as repetition stability or stability to environmental fluctuation. The multilayer type photoreceptor having a charge transporting layer as a surface layer is mainly described below.

Examples of the conductive substrate include cylindrical, belt-like or sheet-like substrates of plastics or paper made conductive by depositing metals on the surface or by forming a film thereon with conductive powders dispersed therein, in addition to metals such as copper, aluminum, nickel and iron, can be used.

In order to prevent interference fringes, the surface of the conductive substrate may be roughened by methods such as etching, anode oxidation, wet blasting, sand blasting, rough lathing and centerless lathing.

The undercoat layer is provided on the above-described conductive substrate. In the present invention, the undercoat layer comprises the copolymer resin having a hydrolytic silyl group, but may contain another film forming material. Further, in order to accelerate curing reaction, a curing catalyst for the hydrolytic silyl group may be contained. Furthermore, when it is intended to reduce resistance, electrically conductive particles may be contained. In addition, the undercoat layer may have a two-layer structure comprising a first undercoat layer containing conductive particles and a second undercoat layer containing no fine conductive particles.

In the present invention, the copolymer resins having a hydrolytic silyl group for use in the undercoat layer include vinyl copolymers comprising a vinyl monomer (a) having a hydrolytic silyl group and another vinyl monomer (b) copolymerizable therewith. The hydrolytic silyl group in the vinyl monomer (a) having a hydrolytic silyl groups include halogenosilyl groups, acyloxysilyl groups, amidosilyl groups, amidoxysilyl groups, aminoxysilyl groups, alkenyloxysilyl groups, aminosilyl groups, oximesilyl groups, alkoxysilyl groups and thioalkoxysilyl groups. Of these, alkoxysilyl groups are preferred. The alkoxysilyl groups preferably has nearly 6 carbon atoms.

Examples of the vinyl monomer having an alkoxysilyl group include vinylsilanes (vinylmethyldimethoxysilane, vinyltrimethoxy-silane, vinyltriethoxysilane, vinyltris(β-methoxyethoxy)-silane, etc.); and acryloxy- or methacryloxyalkylsilanes having an alkoxysilyl group (γ-methacryloxypropyltrimethoxy-silane, γ-methacryloxypropylmethyldimethoxysilane, γ-acryloxypropyltrimethoxysilane, γ-methacryloxypropylmethyl-diethoxysilane, γ-acryloxypropyltriethoxysilane, etc.).

Examples of the other copolymerizable vinyl monomer (b) include, for example, (1) alkyl acrylates or methacrylates (alkyl groups each has 1 to 20 carbon atoms) [methyl acrylate, methyl methacrylate, ethyl acrylate, ethyl methacrylate, n-butyl acrylate, n-butyl methacrylate, 2-ethylhexyl acrylate, 2-ethylhexyl methacrylate, 2-hydroxyethyl acrylate, 2-hydroxyethyl methacrylate, etc.]; (2) aromatic monomers [styrene, α-methylstyrene, α-chlorostyrene, etc.]; (3) vinyl halide monomers [vinyl chloride, etc.]; (4) alkyl- or cycloalkyl vinyl ethers [methyl vinyl ether, cyclohexyl vinyl ether, etc.]; (5) vinyl esters [vinyl acetate, etc.]; (6) nitrile group-containing vinyl monomers [acrylonitrile, etc.]; (7) amido group-containing monomers [acrylamide, methacrylamide, crotonamide, N-methylolacrylamide, fumaric acid diamide, etc.]; (8) epoxy group-containing vinyl monomers [glycidyl acrylate, glycidyl methacrylate, etc.]; (9) vinyl monomers having a fluorine-substituted alkyl group [acrylic esters and methacrylic esters containing a perfluoroalkyl group such as a perfluorooctylethyl group, perfluoroalkyl group-containing maleates such as $C_8F_{17}(CH_2)_{11}OCOCH{=}CHCOOCH_3$], perfluoroalkyl group-containing vinyl ethers such as $C_7F_{15}CH_2OCH{=}CH_2$, etc.]; (10) polydimethyl-siloxane-containing vinyl monomers [$CH_2{=}CHCOO(CH_2)_3{-}[Si(CH_3)_2O]_nSi(CH_3)_3$, $CH_2{=}C(CH_3)COOC_6H_4[Si(CH_3)_2O]_nSi(CH_3)_3$, $CH_2{=}C(CH_3)COO(CH_2)_3[Si(CH_3)_2O]_nSi(CH_3)_3$, $CH_2{=}C(CH_3)COO(CH_2)_3{-}[Si(C_6H_5)_2O]_nSi(CH_3)_3$, etc. (in each formula, n=0 to 130); (11) unsaturated mono- or polycarboxylic acids [acrylic acid, methacrylic acid, crotonic acid, sorbic acid, maleic acid, itaconic acid, cinnamic acid, etc.]; (12) aliphatic and aromatic vinylsulfonic acids [vinylsulfonic acid, allyl-sulfonic acid, vinyltoluenesulfonic acid, styrenesulfonic acid, etc.]; (13) acryl- or methacrylsulfonates [ethyl acryl-sulfonate, ethyl methacrylsulfonate, propyl acrylsulfonate, propyl methacrylsulfonate, etc.]; and (14) polyoxyethylene group-containing vinyl monomers [$CH_2=C(R)COOCH_2CH_2O(CH_2CH_2O)_lH$, $CH_2=C(R)COOCH_2CH_2CH_2O(CH_2CH_2O)_lH$, $CH_2=C(R)COOCH_2CH_2O(CH_2CH_2O)_lR'$, $CH_2=C(R)COOCH_2CH_2CH_2O(CH_2CH_2O)_lR'$ (in each formula, R=H or $CH_3$, l=1 to 200, and R'=an alkyl group having 1 to 10 carbon atoms), $CH_2=C(R)COO(EO/PO)_mH$ and $CH_2=C(R)COO(EO/PO)_mR'$ (in both formulas, R=H or $CH_3$, m=1 to 200, EO is an oxyethylene group, PO is an oxypropylene group, EO/PO>2 (molar ratio), R'=an alkyl group having 1 to 10 carbon atoms)]. Of these other copolymerizable vinyl monomers (b), anionic or nonionic hydrophilic group-containing vinyl monomers ((11) to (14) described above) are preferred, and the polyoxyethylene group-containing vinyl monomers (14) are particularly preferred. The above-described vinyl monomers may be used as a combination of two or more thereof. For the copolymerization ratio of the above-described monomer (a) to the monomer (b) constituting the copolymer resin having a hydrolytic silyl group, the amount of the monomer (a) is generally within the range of 0.01 to 80% by weight, preferably 0.5 to 60% by weight, and the amount of the monomer (b) is generally within the range of 20 to 99.99% by weight, preferably 40 to 99.5% by weight.

The copolymer resin having a hydrolytic silyl group can be produced by radical polymerization such as thermal polymerization, photopolymerization or radiation polymerization of the above-described monomer (a) and monomer (b). Radical polymerization with using a radical initiator for the monomer (a) and the monomer (b) in an organic solvent is preferred. The organic solvents used in the radical polymerization include toluene, xylene, methyl ethyl ketone, methyl isobutyl ketone, n-butyl acetate, cellosolve acetate, ethylene dichloride and mixtures thereof.

As the radical initiator, it is effective to use azo compounds (azobisisobutyronitrile, azobisisovaleronitrile, etc.). In some cases, a chain transfer agent (e.g., n-lauryl mercaptan, n-dodecyl mercaptan, mercaptopropionic acid, t-dodecyl mercaptan, γ-mercaptopropyltrimethoxysilane, γ-mercaptopropylmethyldimethoxysilane, etc.) can be added together with the radical initiator to adjust the molecular weight. The copolymer resin of the present invention preferably has a weight average molecular weight of from 10,000 to 30,000.

As the curing catalysts used for enhancing curing reaction of the copolymer resin having a hydrolytic silyl group, conventional catalysts can be used. Examples thereof include organic titanate compounds (isopropyltriisostearoyl titanate, isopropyltri(dioctylpyro-phosphate) titanate, tetraisopropyldi(laurylphosphite) titanate, etc.), organic aluminum compounds (acetoalkoxy-aluminum diisopropylate, etc.), carboxylic acid type tin compounds (tin dioctanoate, dibutyltin dilaurate, dibutyltin maleate, etc.), sulfide or mercapto type sulfur-containing organic tin compounds (dibutyltin sulfide, etc.), dialkyltin oxides (dibutyltin oxide, dioctyltin oxide, etc.) metal carboxylates (sodium acetate, zinc caproate, lead octylate, cobalt naphthenate, etc.), acid phosphates (acid monomethyl phosphate, acid dimethyl phosphate, acid diethyl phosphate, acid monobutyl phosphate, etc.), carboxylic acids and acid anhydrides thereof (adipic acid, maleic acid, citric acid, iraconic acid, succinic acid, phthalic acid, trimellitic acid, maleic anhydride, phthalic anhydride, etc.), aminosilanes (γ-aminopropyltriethoxysilane, etc.), amines and salts thereof (trietylamine, dibutylamine-2-hexoate, cyclic amidines and salts thereof, etc.) and quaternary ammonium salts (tetrabutylammonium hydroxide, etc.).

These curing catalysts may be used alone or as a combination of two or more thereof. When the curing catalyst is added, the amount added is generally 0.001 to 20% by weight based on the copolymer resin.

In the present invention, other film forming materials may be used in combination with the above-described copolymer resin having a hydrolytic silyl group. Examples of the material which can be used in combination include organic metal compounds containing zirconium, titanium, aluminum, manganese, silicon, etc., as well as polymer compounds such as acetal resins (such as polyvinyl butyral), polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolformaldehyde resins and melamine resins. These compounds can be used alone or as mixtures or polycondensates of the plural compounds. When these compounds are used in combination, the addition amount is generally less than 30% by weight based on the copolymer resin. In particular, the organic metal compounds containing zirconium or silicon atoms are excellent in performance, that is, low in residual potential, and less apt to change in potential due to the environment or by repeated use.

Examples of the organic metal compound containing a silicon atom include silicon compounds such as vinyltrimethoxysilane, vinyltriethoxysilane, vinyltris(β-methoxyethoxy)silane, γ-methacryloxypropyltrimethoxysilane, γ-methacryloxypropyltris(β-methoxyethoxy)silane, β-3,4-epoxycyclohexyl)ethyltrimethoxysilane, γ-glycidoxypropyltri-methoxysilane, vinyltriacetoxysilane, γ-mercaptopropyltri-methoxysilane, γ-aminopropyltriethoxysilane, N-β-(aminoethyl)-γ-aminopropyltrimethoxysilane, N-β-(aminoethyl)-γ-aminopropylmethyldimethoxysilane, N,-N-bis(β-hydroxyethyl)-γ-aminopropyltriethoxysilane, N-phenyl-γ-aminopropyl-trimethoxysilane and γ-chloropropyltrimethoxysilane. Of these, silicon compounds particularly preferably used are silane coupling agents such as vinyltriethoxysilane, vinyltris(β-methoxyethoxy)silane, γ-methacryloxypropyltrimethoxysilane, γ-glycidoxypropyltrimethoxysilane, β-3,4-epoxycyclohexyl)ethyltrimethoxysilane, N-β-(aminoethyl)-γ-aminopropyltrimethoxysilane, N-β-(aminoethyl)-γ-aminopropylmethyldimethoxysilane, γ-aminopropyltriethoxysilane, N-phenyl-γ-aminopropyltrimethoxysilane, γ-mercaptopropyltrimethoxysilane and γ-chloropropyltrimethoxysilane.

Examples of the organic metal compound containing a zirconium atom include zirconium butoxide, zirconium ethyl acetoacetate, zirconium triethanolamine, acetylacetonato zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide and isostearate zirconium butoxide.

Examples of the organic metal compound containing a titanium atom include tetraiopropyl titanate, tetra n-butyl titanate, butyl titanate dimer, tetra(2-ethylhexyl) titanate, titanium acetylacetonato, polytitanium acetylacetonato, titanium octyleneglycolate, titanium lactate ammonium salt, titanium lactate, titanium lactate ethyl ester, titanium triethanolaminate and polyhydroxytitanium stearate.

Examples of the organic metal compound containing an aluminum atom include aluminum isopropylate, monobutoxy-aluminum diisopropylate, aluminum butyrate, diethyl acetoacetate aluminum diisopropylate and aluminum tris(ethyl acetoacetate).

Fine powders are added to the undercoat layers as needed. When the resistance of the undercoat layers is reduced, conductive particles can be added. The conductive particles include particles of metals such as silver, copper, nickel, gold, bismuth, aluminum and iron, carbon particles, metal oxides such as zinc sulfide, titanium oxide, tin oxide, antimony oxide, aluminum oxide, indium oxide, silicon oxide, magnesium oxide, barium oxide and molybdenum oxide, and potassium titanate. Solid solutions or mixtures thereof can also be used. Further, for adjusting the resistance or dispersibility, various kinds of surface treatments may be applied to these conductive particles. In order to reduce the resistance by adding these conductive particles, it is preferred that the content thereof is high. However, the undercoat layer should contain a minimum of 5% resin component for obtaining the film strength. Therefore, the conductive particles is generally added within the range of 5 to 95% by weight based on the undercoat layer.

Fine particles not largely contributing to the improvement in conductivity may be further added to the undercoat layer for the various purposes. For example, dispersing agents to prevent coagulation of the conductive particles, light scattering materials to prevent interference fringes, etc. may be added. Examples thereof include white pigments such as zinc sulfide, white lead and lithopone, extender pigments such as calcium carbonate and barium sulfate, Teflon resin particles, benzoguanamine resin particles and styrene resin particles. These may be added within the range of 10 to 80% by weight, preferably 30 to 70% by weight, based on the solids content of the undercoat layer.

The particle size of the above-described conductive particles and fine particles not largely contributing to the improvement in conductivity is appropriately selected, and the particles having a particle size of 0.01 to 2 μm are generally used. In particular, the range of 0.05 to 1 μm are preferred. A particle size larger than 2 μm increases unevenness of the undercoat layer and electrically partial irregularity, to thereby tend to generate defects in image quality. On the contrary, a particle size smaller than 0.01 μm results in insufficient light scattering effect.

In the preparation of coating solutions for forming the undercoat layer, when the above-described conductive particles and other fine particles are added, those fine particles are added to a solution containing the resin components to conduct dispersing treatment. As methods for conducting dispersing treatment, methods using a roll mill, a ball mill, a vibrating ball mill, an attriter, a sand mill, a colloid mill, a paint shaker, etc. can be used.

The undercoat layer can be formed by spray coating, ring coating, dip coating, etc. in the case of drum photoreceptors, and by spray coating, bead coating, curtain coating, slot coating, etc. in the case of belt-like photoreceptors.

The covering ability to the unevenness of the supports is increased by increasing the film thickness of the undercoat layers, so that the increased thickness generally tends to reduce defects in image quality, but the electrical repetition stability is deteriorated. The thickness is therefore generally within the range of from 0.1 to 20 μm, preferably from 0.1 to 5 μm.

When the above-described undercoat layer contain the conductive particles in the present invention, a second undercoat layer may also be further formed thereon for improving charging ability and image quality, to form an undercoat layer having the two-layer structure. As materials used in that case, the above-described materials which can be used in combination with the copolymer resin having a hydrolytic silyl group can be used. When the undercoat layer has a two-layer structure, the first undercoat layer generally has a thickness of from 0.1 to 20 μm, preferably from 0.1 to 5 μm, and the second undercoat layer generally has a thickness of from 0.1 to 5 μm, preferably 0.1 to 2 μm.

The charge generating layer formed on the above-described undercoat layer is formed by vacuum deposition of a charge generating material or coating a dispersion thereof in an organic solvent and a binder resin. Examples of the charge generating material include inorganic photoconductive materials such as amorphous selenium, crystalline selenium, selenium-tellurium alloys, selenium-arsenic alloys, other selenium compounds and selenium alloys, zinc oxide and titanium oxide; various phthalocyanine pigments such as non-metallic phthalocyanine, titanyl phthalocyanine, copper phthalocyanine, tin phthalocyanine and gallium phthalocyanine; and organic pigments and dyes such as squarylium series, anthoanthrone series, perylene series, azo series, anthraquinone series, pyrene series, pyrylium salts and thiapyrylium salts. These organic pigments generally have several kinds of crystal forms. In particular, various kinds of crystal forms including α, β, etc. are known for the phthalocyanine pigments, and any crystal forms can be used as long as the pigments give the sensitivity meeting the purpose.

Examples of a binder resin for use in the charge generating layer include polycarbonate resins such as bisphenol A or bisphenol Z, polyester resins, methacrylic resins, acrylic resins, polyvinyl chloride resins, polystyrene resins, polyvinyl acetate resins, styrene-butadiene copolymer resins, vinylidene chloride-acrylonitrile copolymer resins, vinyl chloride-vinyl acetate-maleic anhydride resins, silicone resins, silicone-alkyd resins, phenol-formaldehyde resins, styrene-alkyd resins and poly-N-vinylcarbazole.

These binder resins may be used alone or as a combination of two or more thereof. The compounding ratio (weight ratio) of the charge generating material to the binder resin is preferably within the range of 10:1 to 1:10. Further, the film thickness of the charge generating layer is generally within the range of 0.01 to 5 μm, preferably 0.05 to 2.0 μm.

Examples of the organic solvent include cyclohexanone, butyl acetate, xylene, 3-pentanol.

As methods for dispersing the charge generating material in the resin, methods using a roll mill, a ball mill, a vibrating ball mill, an attriter, a dynomill, a sand mill, a colloid mill, etc. can be used.

Examples of a charge transporting material for use in the charge transporting layer include positive hole transporting materials such as oxadiazole derivatives such as 2,5-bis(p-diethylaminophenyl)-1,3,4-oxadiazole, pyrazoline derivatives such as 1,3,5-triphenylpyrazoline and 1-[pyridyl-(2)]-3-(p-diethylaminostyryl)-5-(p-diethylaminostyryl) pyrazoline, aromatic tertiary amino compounds such as triphenylamine, tri(p-methyl)phenylamine, N,N-bis(3,4-dimethylphenyl)-biphenyl-4-amine and dibenzylaniline, aromatic tertiary diamino compounds such as N,N'- diphenyl-N,N'-bis(3-methylphenyl)-[1,1-biphenyl]-4,4'-diamine, 1,2,4-triazine derivatives such as 3-(4'-dimethylaminophenyl)-5,6-di(4'-methoxyphenyl)-1,2,4-triazine, hydrazone derivatives such as 4-diethylaminobenzaldehyde-1,1-diphenylhydrazone, quinazoline derivatives such as 2-phenyl-4-styrylquinazoline, benzofuran derivatives such as 6-hydroxy-2,3-di(p-methoxyphenyl)-benzofuran, α-stilbene derivatives such as p-(2,2-diphenyl-vinyl)-N,N-diphenylaniline, enamine derivatives, carbazole derivatives such as N-ethylcarbazole, and poly-N-vinyl-carbazole and derivatives thereof; electron transporting materials such as quinone compounds such as chloranil, bromanil and anthraquinone, tetracyanoquinodimethane compounds, fluorenone compounds such as 2,4,7-trinitro-fluorenone and 2,4,5,7-tetranitro-9-fluorenone, xanthone compounds, thiophene compounds and diphenoquinone compounds; and polymers having a group comprising the above-described compound on a main chain or a side chain. These charge transporting materials may be used alone or as a mixture of two or more kinds of them.

Examples of a binder resin for use in the charge transporting layer include insulating resins such as acrylic resins, polyarylate resins, polyester resins, polycarbonate resins such as bisphenol A or bisphenol Z, polystyrene resins, acrylonitrile-styrene copolymers, acrylonitrile-butadiene copolymers, polyvinyl butyral, polyvinyl formal, polysulfones, polyacrylamide, polyamides and chlorinated rubber; and organic photoconductive polymers such as polyvinyl carbazole, polyvinyl anthracene and polyvinyl pyrene.

The charge transporting layer can be formed by applying a solution of the above-described charge transporting material and the binder resin in an appropriate solvent and drying the solution applied. The solvents which can be used for forming the charge transporting layer include, for example, aromatic hydrocarbons such as benzene, toluene and chlorobenzene; ketones such as acetone and 2-butanone; aliphatic hydrocarbon halides such as methylene chloride, chloroform and ethylene chloride; cyclic or straight chain ethers such as tetrahydrofuran, dioxane, ethylene glycol and diethyl ether; and mixed solvents thereof. The compounding ratio of the charge transporting material to the above-described binder resin is preferably within the range of 10:1 to 1:5. Further, the film thickness of the charge transporting layer is generally within the range of 5 to 50 μm, preferably 10 to 40 μm.

In order to prevent the deterioration of the photoreceptor due to ozone or oxidizing gases generated in the electrophotographic machines, or due to light or heat, additives such as antioxidants, light stabilizers and heat stabilizers may be added to the photosensitive layer.

For example, the antioxidants include hindered phenols, hindered amines, p-phenylenediamine, arylalkanes, hydroquinone, spirochroman, spiroindanone, derivatives thereof, organic sulfur compounds and organic phosphorus compounds.

Examples of the light stabilizers include derivatives of benzophenone, benzotriazole, dithiocarbamates and tetramethylpiperidine.

For improving the sensitivity, decreasing the residual potential and reducing wear on repeated use, at least one kind of electron acceptor may be added. The electron acceptor which can be used in the photoreceptors of the present invention include, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Of these, the fluorenone series, the quinone series and the benzene derivatives having an electron attractive substituent group such as Cl, CN and $NO_2$ are particularly preferred.

The solutions can be applied by use of coating methods such as dip coating, spray coating, bead coating, blade coating and roller coating. When the humidifying treatment method is not used, drying is preferably conducted by heating after set to touch at room temperature. The drying by heating is preferably conducted at a temperature of 30° to 200° C. for 5 minute to 2 hours.

A surface protective layer generally having a thickness of from 0.1 to 10 μm can be formed on the photosensitive layer as needed. Examples of the surface protective layer include low-resistive protective layers in which a resistance controlling agent is added to an insulating resin layer or an insulating resin. In the case of the low-resistive protective layers, examples thereof include layers in which fine conductive particles are dispersed in an insulating resin. The fine conductive particle is suitably selected from particles having an electric resistance of $10^9$ Ω·cm or less, showing white, grey or bluish white, and having a mean particle size of 0.3 μm or less, preferably 0.1 μm or less. Examples thereof include molybdenum oxide, tungsten oxide, antimony oxide, tin oxide, titanium oxide, indium oxide, a solid solution or a mixture of tin oxide and antimony oxide, and particles in which these metal oxides are incorporated, or which are coated therewith. Of these, tin oxide and the solid solution of tin oxide and antimony oxide are preferred, because they can suitably adjust the electric resistance and a substantially transparent protective layer is obtained. The insulating resins include condensed resins such as polyamides, polyurethanes, polyesters, epoxy resins, polyketones and polycarbonates; and vinyl polymers such as polyvinylketone, polystyrene resins and polyacrylamide.

The electrophotographic photoreceptors of the present invention can be used in electrophotographic machines such as light lens copying machines, laser beam printers emitting near infrared light or visible light, digital copying machines, LED printers and laser facsimiles. For the electrophotographic photoreceptors of the present invention, any of one-component or two-component system normal developers and reversal developers may be used.

The image forming method of the present invention is described below.

FIG. 1 shows one embodiment of a printer in which the electrophotographic photoreceptor of the present invention is used, and the image forming method of the present invention is conducted in the following manner. That is, a surface of a photoreceptor drum 1 is charged with a charging device 3 to which a voltage ranging from 50 to 2,000 V is generally applied from a power source 2 installed in the outside of the printer. Then, exposure is conducted by light from an optical system irradiating an original image or from an image input device 4 such as a laser, LED, etc. to form an electrostatic latent image. The electrostatic latent image thus formed is visualized with toner by use of a developing unit 5 to convert the image to a toner image. In this case, the magnetic brush method can be employed for development. Thereafter, the toner image is transferred to paper 7 with a pressure transfer device or an electrostatic transfer device 6, and fixed with a fixing device 8. On the other hand, toner left on the surface of the photoreceptor drum 1 after transfer is removed by use of a cleaner mechanism 9 using a blade, and charge slightly left on the surface of the photoreceptor drum 1 is erased with a charge erase device 10. Although a charging roll is shown in the drawing as the charging device, a blade type charging device may also be used.

The present invention will be described in detail with reference to the following Examples, but the invention should not be construed as being limited thereto. All the parts and percentages are by weight unless otherwise indicated.

EXAMPLE 1

Sixty parts by weight of xylene was added to 33 parts by weight of a copolymer resin having hydrolytic silyl groups (SA246, manufactured by Sanyo Chemical Industries, Ltd.) which comprises an acrylic copolymer resin base composed of three monomer components, methyl methacrylate, butyl acrylate and γ-methacryloxypropyltri-methoxysilane at a constitution ratio (molar ratio) of 38:35:27, and having a number average molecular weight of 11,000 and a weight average molecular weight of 34,000, followed by stirring. To the resulting mixture, 0.3 part by weight of an organic tin compound catalyst (S-CAT. 24, manufactured by Sankyo Organic Chemicals Co. Ltd.) was further added, and the mixture was stirred. An aluminum substrate of an ED pipe having a diameter of 30 mm which was roughened to an Ra of 0.18 μm by liquid honing treatment was coated with the resulting coating solution by use of a ring coater, followed by curing treatment at 150° C. for 1 hour to form a first undercoat layer having a film thickness of 1 μm.

As a charge generating material, a mixed solution comprising 15 parts by weight of gallium chloride phthalocyanine, 10 parts by weight of a vinyl chloride-vinyl acetate copolymer resin (VMCH, manufactured by Nippon Unicar Co., Ltd.) and 300 parts by weight of n-butyl alcohol was subjected to dispersing treatment in a sand mill for 4 hours. The resulting dispersion was applied onto the above-described first undercoat layer by dip coating, and dried to forms charge generating layer having a film thickness of 0.2 μm. Then, 4 parts by weight of N,N'-diphenyl-N,N'-bis(3-methylphenyl)-[1,1'-biphenyl]-4,4'-diamine and 6 parts by weight of a bisphenol Z polycarbonate resin (molecular weight: 40,000) were added to 80 parts by weight of chlorobenzene, and dissolved therein. The resulting solution was applied onto the above-described charge generating layer, and dried to for a charge transporting layer having a film thickness of 20 μm, thus preparing an electrophotographic photoreceptor composed of three layers.

A printer having a contact charging system (PC-PR1000/4R, manufactured by NEC Corp.) was loaded with the resulting electrophotographic photoreceptor to conduct copying operation. Results obtained with respect residual potential and the image quality of the electrophotographic photoreceptor are shown in Table 1. The environmental fluctuation of residual potential shown in Table 1 was determined from a difference between under high temperature and high humidity (28° C., 85% RH) end under low temperature and low humidity (10° C., 15% RH).

Comparative Example 1

Sixty parts by weight of xylene was added to 33 parts by weight of a methyl methacrylate resin (Elvacite 2021, manufactured by E. I. du Pont de Nemours and Company) to obtain a coating solution. An aluminum substrate of an ED pipe having a diameter of 30 mm which was roughened by liquid honing treatment was coated with the resulting coating solution by use of a ring coater, followed by drying treatment at 150° C. for 1 hour to form an undercoat layer having a film thickness of 1 μm. The charge generating layer and the charge transporting layer were further in turn formed in the same manner as in Example 1 to prepare an electrophoto-graphic photoreceptor. The resulting electrophotographic photoreceptor was evaluated in the same manner as in Example 1. Results thereof are shown in Table 1.

Comparative Example 2

In the preparation of the electrophotographic photoreceptor shown in Example 1, the charge generating layer and the charge transporting layer were formed without forming the undercoat layer to prepare an electrophotographic photoreceptor. The resulting electrophotographic photoreceptor was evaluated in the same manner as in Example 1. Results thereof are shown in Table 1.

TABLE 1

| | Residual Potential | Environmental Fluctuation of Residual Potential | Film Coating Property | Image Quality |
|---|---|---|---|---|
| Example 1 | −48 V | 36 V | No problem | No abnormality |
| Comparative Example 1 | −75 V | 120 V | Unevenness in coating | Leak defects from the charging roll occurred in part |
| Comparative Example 2 | −30 V | 30 V | No problem | Many leak defects from the charging roll occurred |

As is apparent from Table 1, no abnormality in image quality was observed for the electrophotographic photoreceptor having the undercoat layer shown in Example 1, even when the copying test was carried out by use of the printer having the contact charging device, but many charge leaks from the charging roll developed to produce streaky clear defects on copies for the electrophotographic photoreceptors shown in Comparative Examples 1 and 2. Further, the electrophoto-graphic photoreceptor shown in Example 1 gave electric characteristics similar to those of the electrophotographic photoreceptor having no undercoat layer (Comparative Example 1) in repetition stability and environmental fluctuation. In contrast, the electrophotographic photoreceptor of Comparative Example 1 was inferior in environmental stability of image quality characteristics, and showed an increase in residual potential at low temperature and low humidity and a substantial increase in residual potential by repeated use.

EXAMPLE 2

Sixty parts by weight of xylene was added to 33 parts by weight of the copolymer resin having hydrolytic silyl groups (SA246, manufactured by Sanyo Chemical Industries, Ltd.) used in Example 1. An aluminum substrate of an ED pipe having a diameter of 30 mm which was roughened to an Ra of 0.18 μm by liquid honing treatment was coated with the resulting coating solution by use of a ring coater, followed by curing treatment at 170° C. for 1 hour to form an undercoat layer having a film thickness of 1 μm.

As a charge generating material, a mixed solution comprising 15 parts by weight of hydroxygallium phthalocyanine, 10 parts by weight of a polyvinyl butyral resin (S-LEK BM-S, manufactured by Sekisui Chemical Co., Ltd.) and 300 parts by weight of n-butyl alcohol was subjected to dispersing treatment in a sand mill for 4 hours. The resulting dispersion was applied onto the above-described undercoat layer by dip coating, and dried to form a charge generating layer having a film thickness of 0.2 μm. Then, 4 parts by weight of N,N'-bis(3,4-dimethylphenyl) biphenyl-4-amine and 6 parts by weight of a bisphenol Z polycarbonate resin (molecular weight: 40,000) were added to 80 parts by weight of chlorobenzene, and dissolved therein. The resulting solution was applied onto the above-described charge generating layer, and dried to form a charge transporting layer having a film thickness of 20 μm, thus preparing an electrophotographic photoreceptor composed of three layers.

A printer having a contact charging system (PC-PR1000/4R, manufactured by NEC Corp.) was loaded with the resulting electrophotographic photoreceptor to conduct copying operation. Results obtained with respect to the residual potential and the image quality of the electrophotographic photoreceptor are shown in Table 2.

EXAMPLES 3 AND 4

The constitution ratio (molar ratio) of monomer components of methyl methacrylate, butyl acrylate and γ-methacryloxypropyltrimethoxysilane in the acrylic resin having hydrolytic silyl groups shown in Example 2 was changed to 25:23:52 (Example 3) and 46:43:11 (Example 4) to prepare acrylic resins having hydrolytic silyl groups, and undercoat layers were, respectively, formed thereon in the same manner as in Example 2. The charge generating layers and the charge transporting layers were further in turn formed thereon in the same manner as in Example 1, thereby preparing electrophotographic photoreceptors of Examples 3 and 4.

The resulting electrophotographic photoreceptors were subjected to copying operation and evaluated in the same manner as in Example 1. Results obtained are shown in Table 2.

EXAMPLE 5

Using azobisisobutyronitrile as a radical polymerization initiator, 50 parts by weight of $CF_3(CF_2)_5(CH_2)_2OCOCH{=}CH_2$, 47 parts by weight of n-butyl acrylate and 3 parts by weight of γ-mercaptopropyltrimethoxysilane were copolymerized in xylene to synthesize a copolymer resin. An undercoat layer was formed using this resin in the same manner as in Example 2. The charge generating layer and the charge transporting layer were further in turn formed thereon in the same manner as in Example 2.

The resulting electrophotographic photoreceptor was subjected to copying operation and evaluated in the same manner as in Example 1. Results obtained are shown in Table 2.

Comparative Example 3

Eighteen parts by weight of a polyamide resin (Luckamide 5003, manufactured by Dainippon Ink & Chemicals Inc.) was used in place of the acrylic resin having hydrolytic silyl groups used in the undercoat layer in Example 2, and mixed with a solvent comprising 17 parts by weight of methanol and 17 parts by weight of water. An aluminum substrate of an ED pipe having a diameter of 30 mm which was roughened to an Ra of 0.18 μm by liquid honing treatment was coated with the resulting coating solution by use of a ring coater, followed by drying at 150° C. for 30 minutes to conduct curing treatment, thereby forming an undercoat layer having a film thickness of 1 μm. The charge generating layer and the charge transporting layer were further in turn formed thereon in the same manner as in Example 2.

The resulting electrophotographic photoreceptor was subjected to copying operation and evaluated in the same manner as in Example 1. Results obtained are shown in Table 2.

Comparative Example 4

Thirty three parts by weight of a polyvinyl alcohol resin (PVA-217, manufactured by Kuraray Co. Ltd.) was used in place of the acrylic resin having hydrolytic silyl groups used in the undercoat layer in Example 2, and 86 parts by weight of water added thereto. An aluminum substrate of an ED pipe having a diameter of 30 mm which was roughened to an Ra of 0.18 μm by liquid honing treatment was coated with the resulting coating solution by use of a ring coater, followed by drying at 120° C. for 30 minutes to form an undercoat layer having a film thickness of 1 μm. The charge generating layer and the charge transporting layer were further in turn formed thereon in the same manner as in Example 2.

The resulting electrophotographic photoreceptor was subjected to copying operation and evaluated in the same manner as in Example 1. Results obtained are shown in Table 2.

EXAMPLE 6

Fifteen parts by weight op xylene was added to 33 parts by weight of the copolymer resin having hydrolytic silyl groups (SA246, manufactured by Sanyo Chemical Industries, Ltd.) used in Example 1. With the resulting solution, 30 parts by weight of alumina silica-coated rutile form titanium oxide (R7E, manufactured by Sakai Chemical Industry Co. Ltd.) was mixed, and dispersed in a sand grind mill for 3 hours. Then, 20 parts by weight of xylene was added to the resulting mixture, followed by mixing and stirring to obtain a coating solution for an undercoat layer. An aluminum substrate of an ED pipe having a diameter of 30 mm which was roughened to an Ra of 0.18 μm by liquid honing treatment was coated with the resulting coating solution by use of a ring coater, followed by curing treatment at 170° C. for 1 hour to form an undercoat layer having a film thickness of 5 μm. The charge generating layer and the charge transporting layer were further in turn formed thereon in the same manner as in Example 2.

The resulting electrophotographic photoreceptor was subjected to copying operation and evaluated in the same manner as with Example 1. Results obtained are shown in Table 2.

EXAMPLE 7

Twenty-five parts by weight of xylene was added to 33 parts by weight of a copolymer resin having hydrolytic silyl groups (comprising an acrylic copolymer resin base composed of three monomer components, methyl methacrylate, butyl acrylate and γ-methacryloxypropyltri-methoxysilane at a constitution ratio (molar ratio) of 25:23:52, and having a number average molecular weight of 11,000 and a weight average molecular weight of 34,000). With this solution, 30 parts by weight of zirconium acetylacetonato tetrabutoxide (ZC540, manufactured by Matsumoto Seiyaku Co.) was mixed. An aluminum substrate of an ED pipe having a diameter of 30 mm which was toughened to an Ra of 0.18 μm by liquid honing treatment was coated with the resulting coating solution by use of a ring coater, followed by curing treatment at 170° C. for 1 hour to form an undercoat layer having a film thickness of 1 μm. The charge generating layer and the charge transporting layer were further in turn formed thereon in the same manner as in Example 2.

The resulting electrophotographic photoreceptor was subjected to copying operation and evaluated in the same manner as in Example 1. Results obtained are shown in Table 2.

EXAMPLE 8

Twenty-five parts by weight of xylene was added to 33 parts by weight of the copolymer resin having hydrolytic silyl groups (SA246, manufactured by Sanyo Chemical Industries, Ltd.) used in Example 1. With the resulting solution, 30 parts by weight of γ-aminopropyltriethoxysilane (A1100, manufactured by Nippon Unicar Co., Ltd.) was mixed. An aluminum substrate of an ED pipe having a diameter of 30 mm which was toughened to an Ra of 0.18 μm by liquid honing treatment was coated with the resulting coating solution by use of a ring coater, followed by curing treatment at 170° C. for 1 hour to form an undercoat layer having a film thickness of 1 μm. The charge generating layer and the charge transporting layer were further in turn formed thereon in the same manner as in Example 2.

The resulting electrophotographic photoreceptor was subjected to copying operation and evaluated in the same manner as in Example 1. Results obtained are shown in Table 2.

TABLE 2

| | Residual Potential | Environmental Fluctuation of Residual Potential | Image Quality |
|---|---|---|---|
| Example 2 | −48 V | 48 V | No abnormality |
| Example 3 | −43 V | 51 V | No abnormality |
| Example 4 | −49 V | 46 V | No abnormality |
| Example 5 | −53 V | 53 V | No abnormality |
| Comparative Example 3 | −79 V | 78 V | Fog occurred |
| Comparative Example 4 | −97 V | 130 V | Leak defects from the charging roll occurred |
| Example 6 | −40 V | 42 V | No abnormality |
| Example 7 | −47 V | 49 V | No abnormality |
| Example 8 | −49 V | 51 V | No abnormality |

As is apparent from Table 2, the electrophotographic photoreceptors in Examples of the present invention in which the copolymer resins having hydrolytic silyl groups are used in the undercoat layers are low in residual potential and environmental dependency thereof. Further, even when the contact charging system is used, no current leak occurs and excellent image quality is obtained.

EXAMPLE 9

Thirty-two parts by weight of tin oxide powder (S-1, manufactured by Mitsubishi Material Co. Ltd.) having a particle size distribution that particles with a particle size of 1.3 μm or less account for 90%, particles with a particle size of 0.15 μm or less account for about 30%, and particles with a particle size of 0.15 to 0.25 μm account for about 30% was added to 43 parts by weight of a copolymer resin having hydrolytic silyl groups (SA246, manufactured by Sanyo Chemical Industries, Ltd.) which comprises an acrylic copolymer resin base composed of three monomer components, methyl methacrylate, butyl acrylate and γ-methacryloxypropyltrimethoxysilane at a constitution ratio (molar ratio) of 38:35:27, and having a number average molecular weight of 11,000 and a weight average molecular weight of 34,000. The mixture, together with 30 parts by weight of xylene and 900 parts by weight of stainless steel balls having a diameter of 6 mm, was placed in a stainless steel ball mill pot having a diameter of 90 mm and a height of 90 mm, followed by dispersing treatment at 120 rpm for 20 hours. To the resulting mixture, 0.3 part by weight of an organic tin compound catalyst (S-CAT. 24, manufactured by Sankyo Organic Chemicals Co. Ltd.) was further added, and the mixture was stirred. An aluminum substrate of an ED pipe having a diameter of 30 mm which was roughened to an Ra of 0.25 μm by liquid honing treatment was coated with the resulting coating solution by use of a ring coater, followed by curing treatment at 150° C. for 1 hour to form a first undercoat layer having a film thickness of 20 μm.

Further, 170 parts by weight of n-butyl alcohol in which 4 parts by weight of a polyvinyl butyral resin (S-LEK BM-S, manufactured by Sekisui Chemical Co., Ltd.) was dissolved, 30 parts by weight of an organic zirconium compound (acetyl-acetone zirconium butyrate) and 3 parts by weight of an organic silane compound (γ-aminopropyltrimethoxysilane) were additionally mixed therewith, followed by stirring to obtain a coating solution for a second undercoat layer. This coating solution was applied onto the first undercoat layer by use of a ring coater, and air-dried at room temperature for 5 minutes, followed by drying and curing in a hot air dryer at 170° C. for 10 minutes to form the second undercoat layer having a thickness of 1 μm.

As a charge generating material, a mixed solution comprising 15 parts by weight of gallium chloride phthalocyanine, 10 parts by weight of a vinyl chloride-vinyl acetate copolymer resin (VMCH, manufactured by Nippon Unicar Co., Ltd.) and 300 parts by weight of n-butyl alcohol was subjected to dispersing treatment in a sand mill for 4 hours. The resulting dispersion was applied onto the above-described second undercoat layer by dip coating, and dried to form a charge generating layer having a film thickness of 0.2 μm. Then, 4 parts by weight of N,N'-diphenyl-N,N'-bis (3-methylphenyl)-[1,1'-biphenyl]-4,4'-diamine and 6 parts by weight of a bisphenol Z polycarbonate resin (molecular weight: 40,000) were added to 80 parts by weight of chlorobenzene, and dissolved therein. The resulting solution was applied onto the charge generating layer, and dried to form a charge transporting layer having a film thickness of 20 μm, thus preparing an electrophotographic photoreceptor composed of four layers.

A printer having a contact charging system (PC-PR1000/4R, manufactured by NEC Corp.) was loaded with the resulting electrophotographic photoreceptor to conduct occupying operation. Results obtained with respect to the residual potential and the image quality of the electrophotographic photoreceptor are shown in Table 3.

Comparative Example 5

Thirty-two parts by weight of tin oxide powder (S-1, manufactured by Mitsubishi Material Co. Ltd.) having a particle size distribution that particles with a particle size of 1.3 μm or less account for 90%, particles with a particle size of 0.15 μm or less account for about 30%, and particles with a particle size of 0.15 to 0.25 μm account for about 30% was added to 43 parts by weight of a methyl methacrylate resin (Elvacite 2021, manufactured by E. I. du Pont de Nemours and Company), and the mixture, together with 30 parts by weight of xylene and 900 parts by weight of stainless steel balls having a diameter of 6 mm, was placed in a stainless steel ball mill pot having a diameter of 90 mm and a height of 90 mm, followed by dispersing treatment at 120 rpm for 20 hours. An aluminum substrate of an ED pipe having a diameter of 30 mm which was roughened by liquid honing treatment was coated with the resulting coating solution by use of a ring coater, followed by drying treatment at 150° C. for 1 hour to form a first undercoat layer having a film thickness of 15 μm. The second undercoat layer, the charge generating layer and the charge transporting layer were further in turn formed in the same manner as in Example 9 to prepare an electrophotographic photoreceptor. The resulting electrophotographic photoreceptor was evaluated in the same manner as in Example 9. Results thereof are shown in Table 3.

Comparative Example 6

In the preparation of the electrophotographic photoreceptor shown in Example 9, the second undercoat layer, the charge generating layer and the charge transporting layer were formed without forming the first undercoat layer to form an electrophotographic photoreceptor. The resulting electrophotographic photoreceptor was evaluated in the same manner as in Example 9. Results thereof are shown in Table 3.

TABLE 3

| | Residual Potential | Environmental Fluctuation Residual Potential | Film Coating Property | Image Quality |
|---|---|---|---|---|
| Example 9 | −48 V | 36 V | No problem | No abnormality |
| Comparative Example 5 | −65 V | 61 V | Unevenness in coating | Leak defects from the charging roll occurred in part |
| Comparative Example 6 | −46 V | 34 V | No problem | Many leak defects from the charging roll occurred |

As is apparent from Table 3, no abnormality in image quality was observed for the electrophotographic photoreceptor having the undercoat layer shown in Example 9, even when the copying test was carried out by use of the printer having the contact charging device. However, many charge leaks from the charging roll developed to produce streaky clear defects on copies for the electrophotographic photoreceptors shown in Comparative Examples 5 and 6. Further, the electrophoto-graphic photoreceptor shown in Example 9 gave electric characteristics similar to those of the electrophotographic photoreceptor having no undercoat layer (Comparative Example 6) in repetition stability and environmental fluctuation. In contrast, the electrophotographic photoreceptor of Comparative Example 5 was inferior in environmental stability of image quality characteristics, and showed an increase in residual potential at low temperature and low humidity and a substantial increase in residual potential by repeated use.

EXAMPLE 10

Thirty parts by weight of tin oxide/antimony oxide powder (T-1, manufactured by Mitsubishi Material Co. Ltd.) was added to 43 parts by weight of the copolymer resin having hydrolytic silyl groups (SA246, manufactured by Sanyo Chemical Industries, Ltd.) used in Example 9, and the mixture, together with 30 parts by weight of xylene, was subjected to dispersing treatment in a ball mill in the same manner as with Example 9. An aluminum substrate of an ED pipe having a diameter of 30 mm which was roughened to an Ra of 0.25 μm by liquid honing treatment was coated with the resulting coating solution by use of a ring coater, followed by curing treatment at 170° C. for 1 hour to form a first undercoat layer having a film thickness of 15 μm.

Further, 170 parts by weight of n-butyl alcohol in which 4 parts by weight of a polyvinyl butyral resin (S-LEK BM-S, manufactured by Sekisui Chemical Co., Ltd.) was dissolved, 30 parts by weight of an organic zirconium compound (acetyl-acetone zirconium butyrate) and 3 parts by weight of an organic silane compound (γ-aminopropyltrimethoxysilane) were additionally mixed therewith, followed by stirring to obtain a coating solution for an undercoat layer. This coating solution was applied onto the first undercoat layer by use of a ring coater, and air-dried at room temperature for 5 minutes, followed by drying and curing in a hot air dryer at 170° C. for 10 minutes to form the second undercoat layer having a thickness of 1.2 μm.

As a charge generating material, a mixed solution comprising 15 parts by weight of hydroxygallium phthalocyanine, 10 parts by weight of a polyvinyl butyral resin (S-LEK BM-S, manufactured by Sekisui Chemical Co., Ltd.) and 300 parts by weight of n-butyl alcohol was subjected to dispersing treatment in a sand mill for 4 hours. The resulting dispersion was applied onto the above-described second undercoat layer by dip coating, and dried to form a charge generating layer having a film thickness of 0.2 μm. Then, 4 parts by weight of N,N-bis(3,4-dimethylphenyl)-biphenyl-4-amine and 6 parts by weight of a bisphenol Z polycarbonate resin (molecular weight: 40,000) were added to 80 parts by weight of chlorobenzene, and dissolved therein. The resulting solution was applied onto the charge generating layer, and dried to form a charge transporting layer having a film thickness of 20 μm, thus preparing an electrophotographic photoreceptor composed of four layers.

A printer having a contact charging system (PC-PR1000/4R, manufactured by NEC Corp.) was loaded with the resulting electrophotographic photoreceptor to conduct copying operation. Results obtained with respect to the residual potential and the image quality of the electrophotographic photoreceptor are shown in Table 4.

EXAMPLES 11 AND 12

In the acrylic resin having hydrolytic silyl groups shown in Example 10, the constitution ratio of monomer components of methyl methacrylate, butyl acrylate and γ-methacryloxypropyltrimethoxysilane was changed to 25:23:52 (Example 11) and 46:43:11 (Example 12) to prepare acrylic resins having hydrolytic silyl groups, and first undercoat layers were, respectively, formed in the same manner as in Example 10. The second undercoat layers, the charge generating layers and the charge transporting layers were further in turn formed thereon in the same manner as in Example 10.

The resulting electrophotographic photoreceptors were subjected to copying operation and evaluated in the same manner as in Example 10. Results thereof are shown in Table 4.

EXAMPLE 13

Using azobisisobutyronitrile as a radical polymerization initiator, 50 parts by weight of $CF_3(CF_2)_5(CH_2)_2OCOCH{=}CH_2$, 47 parts by weight of n-butyl acrylate and 3 parts by weight of γ-mercaptopropyltrimethoxysilane were copolymerized in xylene to synthesize a copolymer resin. A first undercoat layer was formed using this resin in the same manner as in Example 10. The second undercoat layer, the charge generating layer and the charge transporting layer were further in turn formed thereon in the same manner as in Example 10.

The resulting electrophotographic photoreceptor was subjected to copying operation and evaluated in the same manner as in Example 10. Results thereof are shown in Table 4.

Comparative Example 7

Forty three parts by weight of a phenol resin (Plyophen, manufactured by Dainippon Ink & Chemicals Inc.) and 30 parts by weight of tin oxide/antimony oxide powder (T-1, manufactured by Mitsubishi Material Co. Ltd.) were used in place of the acrylic resin having hydrolytic silyl groups used in the first undercoat layer in Example 10, and mixed with a solvent comprising 17 parts by weight of methanol and 17 parts by weight of methyl cellosolve, followed by dispersing treatment in a ball mill for 20 hours. An aluminum substrate of an ED pipe having a diameter of 30 mm which was roughened to an Ra of 0.25 μm by liquid honing treatment was coated with the resulting coating solution by use of a ring coater, followed by drying at 150° C. for 30 minutes to conduct curing treatment, thereby forming a first undercoat layer having a film thickness of 15 μm. The second undercoat layer, the charge generating layer and the charge transporting layer were further in turn formed thereon in the same manner as in Example 10.

The resulting electrophotographic photoreceptor was subjected to copying operation and evaluated in the same manner as in Example 10. Results thereof are shown in Table 4.

Comparative Example 8

Eighty six parts by weight of water was added to 43 parts by weight of a polyvinyl alcohol resin (PVA-217, manufactured by Kuraray Co. Ltd.) in place of the acrylic resin having hydrolytic silyl groups used in the first undercoat layer in Example 10, and 30 parts by weight of tin oxide/antimony oxide powder (T-1, manufactured by Mitsubishi Material Co. Ltd.) was added thereto with stirring. The mixture was subjected to dispersing treatment in a ball mill for 20 hours. An aluminum substrate of an ED pipe having a diameter of 30 mm which was roughened to an Ra of 0.25 μm by liquid honing treatment was coated with the resulting coating solution by use of a ring coater, followed by drying at 120° C. for 30 minutes to form a first undercoat layer having a film thickness of 15 μm. The second undercoat layer, the charge generating layer and the charge transporting layer were further in turn formed thereon in the same manner as in Example 10.

The resulting electrophotographic photoreceptor was subjected to copying operation and evaluated in the same manner as in Example 10. Results thereof are shown in Table 4.

TABLE 4

| | Residual Potential | Environmental Fluctuation of Residual Potential | Image Quality |
|---|---|---|---|
| Example 10 | −46 V | 35 V | No abnormality |
| Example 11 | −43 V | 36 V | No abnormality |
| Example 12 | −48 V | 34 V | No abnormality |
| Example 13 | −50 V | 37 V | No abnormality |
| Comparative Example 7 | −72 V | 62 V | High back ground |
| Comparative Example 8 | −58 V | 124 V | Many leak defects from the charging roll occurred |

As is apparent from Table 4, the electrophotographic photoreceptors in Examples of the present invention in which the copolymer resins having hydrolytic silyl groups are used in the first undercoat layers are low in residual potential and environmental dependency thereof. Further, even when the contact charging system is used, no current leak occurs and excellent image quality is obtained.

In the electrophotographic photoreceptore of the present invention, the copolymer resin having a hydrolytic silyl group is used for forming the undercoat layer as described above, so that the residual potential and the environmental dependency thereof are decreased. Further, ever when the contact charging system is used, no current leak occurs and copied images excellent in image quality are obtained.

What is claimed is:

1. An electrophotographic photoreceptor comprising a conductive substrate having thereon an undercoat layer and a photosensitive layer, wherein said undercoat layer comprises a copolymer resin containing a monomer having a hydrolytic silyl group co-polymerized to a different monomer.

2. The electrophotographic photoreceptor according to claim 1, wherein said copolymer resin is an acrylic copolymer resin.

3. The electrophotographic photoreceptor according to claim 1, wherein said undercoat layer contains electrically conductive particles.

4. The electrophotographic photoreceptor according to claim 3, wherein said electrically conductive particles are particles of a metal oxide.

5. The electrophotographic photoreceptor according to claim 1, wherein said undercoat layer comprises a plurality of layers.

6. The electrophotographic photoreceptor according to claim 5, wherein at least one of said plurality of layers is an electrically conductive layer.

7. An image forming method comprising the steps of:

supplying a charge from a power source to a charging device;

charging an electrophotographic photoreceptor comprising a conductive substrate having thereon an undercoat layer and a photosensitive layer in this order;

imagewise exposing the photoreceptor to form a latent image thereon;

developing said latent image to form a toner image;

transferring said toner image; and fixing the transferred image, wherein said undercoat layer comprises a copolymer resin containing a monomer having a hydrolytic silyl group co-polymerized to a different monomer, and said charging step is conducted by contacting said charging device with the surface of said electrophotographic photoreceptor to supply charge from the power source.

8. The electrophotographic photoreceptor according to claim 1, wherein said copolymer resin is a vinyl copolymer resin comprising a vinyl monomer having a hydrolytic silyl group co-polymerized with a different vinyl monomer.

9. The electrophotographic photoreceptor according to claim 1, wherein the copolymer resin contains 0.1 to 80% by weight monomer having a hydrolytic silyl group.

10. The image forming method according to claim 7, wherein said copolymer resin is a vinyl copolymer resin comprising a vinyl monomer having a hydrolytic silyl group co-polymerized with a different vinyl monomer.

11. The image forming method according to claim 7, wherein the copolymer resin contains 0.1 to 80% by weight monomer having a hydrolytic silyl group.

12. The image forming method according to claim 7, wherein said copolymer resin is an acrylic copolymer resin.

13. The image forming method according to claim 7, wherein said undercoat layer contains electrically conductive particles.

14. The image forming method according to claim 13, wherein said electrically conductive particles are particles of a metal oxide.

15. The image forming method according to claim 7, wherein said undercoat layer comprises a plurality of layers.

16. The image forming method according to claim 15, wherein at least one of said plurality of layers is an electrically conductive layer.

* * * * *